US005726680A

United States Patent [19]

Paley et al.

[11] Patent Number: 5,726,680

[45] Date of Patent: Mar. 10, 1998

[54] PROCESS FOR DISPLAYING TEXT IN THE CGA GRAPHIC MODE ON THE SCREEN OF A PERSONAL COMPUTER

[75] Inventors: Greg Paley, Mountain View, Calif.; Wulf Bauer, Cologne, Germany

[73] Assignee: Vobis Microcomputer AG, Mountain View, Calif.

[21] Appl. No.: 537,886

[22] PCT Filed: Feb. 17, 1995

[86] PCT No.: PCT/DE95/00203

§ 371 Date: Jan. 18, 1996

§ 102(e) Date: Jan. 18, 1996

[87] PCT Pub. No.: WO95/22813

PCT Pub. Date: Aug. 24, 1995

[30] Foreign Application Priority Data

Feb. 21, 1994 [DE] Germany ..... 44 05 329.0

[51] Int. Cl.[6] ..... G09G 5/22

[52] U.S. Cl. ..... 345/132; 345/141; 345/192

[58] Field of Search ..... 345/132, 133, 345/141–143, 192–195; 395/503, 504, 507, 509, 511, 512, 514, 520, 522, 526, 167, 168, 169, 171

[56] References Cited

U.S. PATENT DOCUMENTS 5,208,908 5/1993 Harrison et al. ..... 345/193
5,404,445 4/1995 Matsumoto ..... 395/520
5,502,808 3/1996 Goddard et al. ..... 395/509

FOREIGN PATENT DOCUMENTS 071744 2/1983 European Pat. Off. .
422294 4/1991 European Pat. Off. .

OTHER PUBLICATIONS

IBM Technical Disclosure Bulletin, Video Compatibility Feature, V. 28, No. 6, Nov. 1985, pp. 2615–2620.

*Primary Examiner*—Steven Saras
*Attorney, Agent, or Firm*—John Lezdey

[57] ABSTRACT

The invention relates to a procedure for the presentation of text in a CGA-graphic mode on a screen of a personal computer, which on one hand, shows a processor and a memory allocated to it, in which binary patterns of the text to be presented are stored and on the other hand, a video-card connected with such processor via an external bus. The video-card possesses a video-memory whose memory contents can be presented on the screen. For text-output a bit-sequence is produced for each pixel containing a two-bit sequence, especially 00, determining the background-color. The stored bit pattern of the text signs is connected with this bit-sequence. If the bit 0 exists in the stored bit pattern for the respective pixel, no change is made. If the bit 1 exists in the stored bit for the respective pixel, a bit sequence containing two bit is produced, which determines the desired front color and is stored in the video-memory.

4 Claims, 3 Drawing Sheets

PROCESS FOR DISPLAYING TEXT IN THE CGA GRAPHIC MODE ON THE SCREEN OF A PERSONAL COMPUTER

BACKGROUND OF THE INVENTION

1. Field of the Invention

The invention relates to a procedure for the presentation of text in a CGA-graphic mode on a screen of a personal computer, which on one hand shows a processor and a memory allocated to it, in which binary patterns of the text to be presented are stored, and on the other hand a video-card connected with such processor via an external bus. Such video-card has a video-memory whose memory contents can be presented on the video-screen, whereas on demand of a text character, first of all its binary pattern is called from the memory, this is supplemented by character-colour (front colour) and background-colour stored as a pixel-pattern in the video-memory and displayed on the screen.

2. Description of the Prior Art

Part of the CGA graphic-modes are the 320 times 200 bit-mode, carrying the BIOS-Code 4 and, with which four colours can be presented on the screen at the same time, some restrictions given, the 620 times 200 bit-mode, carrying the BIOS-Code 6 and enabling a presentation in two colours and finally a variant of the first-mentioned graphic-mode, carrying the mode-code 5 in the BIOS-nomenclature and in which the colour-signal is suppressed, by that producing various shades of grey. These graphic-modes are used and picked-up relatively seldom by modern software programs, but are principally supported by operating systems, because some, i.e. older programs have to resort to these modes necessarily. Full compatibility of a personal computer is only reached when the mentioned modes 4,5 and 6 are also supported.

When displaying graphic presentations, the application program has to write the two-bit value for each pixel directly into the video-memory. When presenting text, however, a special way is chosen and BIOS-functions are provided which will make it easier for the application-programmer to present text, so that the program will not have to create each text character, pixel by pixel, in each case. At least one setting of finished binary patterns are stored in one memory, with which a setting of standard text characters can be produced. To be able to present a text character, the application program will only have to message the ASCII-value of the text character to be presented to the BIOS-program, which will then provide the respective pixel-information.

The procedure of the above mentioned kind is known from the European patent 71 744. The binary pattern of a character to be presented is present in such a way that for each subsequent pixel appearing on the screen only one bit is used. The bits are then doubled, after that the colour or shades of grey attributes etc. are added. After that, this information, meaning two bits per pixel is transferred via the external bus to the video-card.

When displaying text the pixels of a text character to be presented are produced on the screen in a chosen foreground colour. The environment around these mentioned pixels is reproduced in a chosen background colour. I.e. the foreground colour is yellow, the background colour is blue. For the simplification of the description two different shades of grey are named as foreground colour and background colour, too.

The procedure of the above mentioned kind is known from the European patent 71 744. The binary pattern of a character to be presented is stored in a one-bit per pixel form. For each pixel addressed to on the screen only one bit is used.

With the procedure known these bits are first doubled, then the colour attributes are added. The information present in such a way, meaning two bits per pixel, is transferred to the video-card via the external bus and stored in the video memory.

With this procedure all two-bit information, meaning a value of one pixel in each case, are written into the video-memory, independent from whether the actual pixel-presentation is modified (foreground colour) or not (background colour). This results in the transfer of a fair amount of information per time via the external bus.

It is the object of the invention to improve and speed up the presentation of text in the CGA-graphic-mode on a screen of a personal computer by avoiding the limitations of the CGA-standard and by improving the use of the possibilities of a modern personal computer.

SUMMARY OF THE INVENTION

Based on the process of the above mentioned kind this object is solved in such a way that the external bus is at least 16 bit wide and that the video-card is at least a VGA-card and the complete pixel-pattern of the text character to be displayed is produced in the immediate vicinity of the processor in the memory and is transferred in this form via the external bus to the video-card, where it is stored in the video-memory.

According to the invention the CGA-compatible graphic-modes 4, 5 and 6 are exemplified in an improved and speeded-up version while compatibility remains. The VGA-video-card is not operated as a CGA-video-card, but can exploit its full capacities and capability characteristics. The external bus is provided with at least 16 bit, that is double the amount of the CGA-standard. Processors like x386 and higher enable an essentially faster data-processing. According to the invention the full pixel-picture of a text character to be presented, with colour and attribute and information, is produced in the RAM-memory in the immediate environment of the processor and then transferred to the video-card via the external bus in this completed form. The display of a text character composed by several bits per pixel is produced by the processor and lead to the video-card, in a finished form, suitable for storage in the video memory. The advantage of this is that via the external bus only for those pixels an information needs to be transferred, for which the foreground-colour changed.

According to the invention the CGA-compatible graphic-modes are clearly improved in this way and by that also a distinct improvement of processing speed for the software programs, resorting to these graphic modes, is reached, at least one part of the advantage which was reached with the development of the personal computer from the original 8088/8086 processor to a processor of the type 80386 or higher. A user of older software, resorting to the mentioned CGA-compatible graphic-modes, gains the advantage when buying a modern computer and using it. He would not have this advantage or only in a diminished way, when using the CGA-standard as described in the above-mentioned patent.

In a preferred embodiment the processor is equipped with a cache-memory or such memory is allocated to the processor, by that the processing speed and the presentation speed are augmented.

If a user wants an inverted video-presentation, the above mentioned logic is reversed, meaning foreground-colour changing to background-colour and background-colour changing to foreground-colour. If attributes as i.e. intensity need to be changed, another foreground-colour for the pixel to be presented more intensively is chosen.

In a possible, preferred embodiment of the invention the BIOS-interrupt 10h is trapped, stored and diverted to an internal routine, where it is reviewed whether it is a question of video-modes 4, 5 and 6. That way the remaining video-modes remain untouched and only the already mentioned CGA-compatible modes are changed.

The invention is explained further with regard to the drawing, in which a non-limiting embodiment is illustrated. This is explained further with regard to the drawing in the following. The drawing shows in:

BRIEF DESCRIPTION OF THE PREFERRED DRAWINGS

FIG. 1 a flowchart representing the program-run during the initial testing when switching on the computer, FIG. 2 a flowchart for the diversion of the BIOS-interrupt 10h for the CGA-compatible modes 4,5 and 6 and FIG. 3 a flow diagram for the run of a presentation of text according to the invention.

DESCRIPTION OF THE PREFERRED EMBODIMENTS

Figure 1:
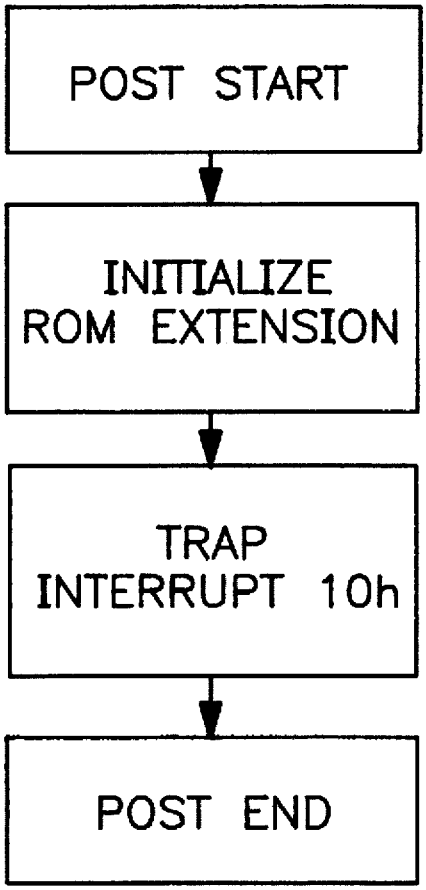

FIG. 1 shows the program run as it runs with the initial test the so-called POST, the English abbreviation for power on self test. When switching on the computer, meaning with "start", numerous tests are being executed which relate to the central hardware of the personal computer, i.e. processor, memory, interrupt-controller, DMA etc. Also ROM-extensions are tested, which are either positioned on the motherboard or on the extension-card and which have the task to extend or replace the functions of the BIOS. Such extensions can be recognised by the first two byte in the memory environment which is allocated by them.

Figure 2:
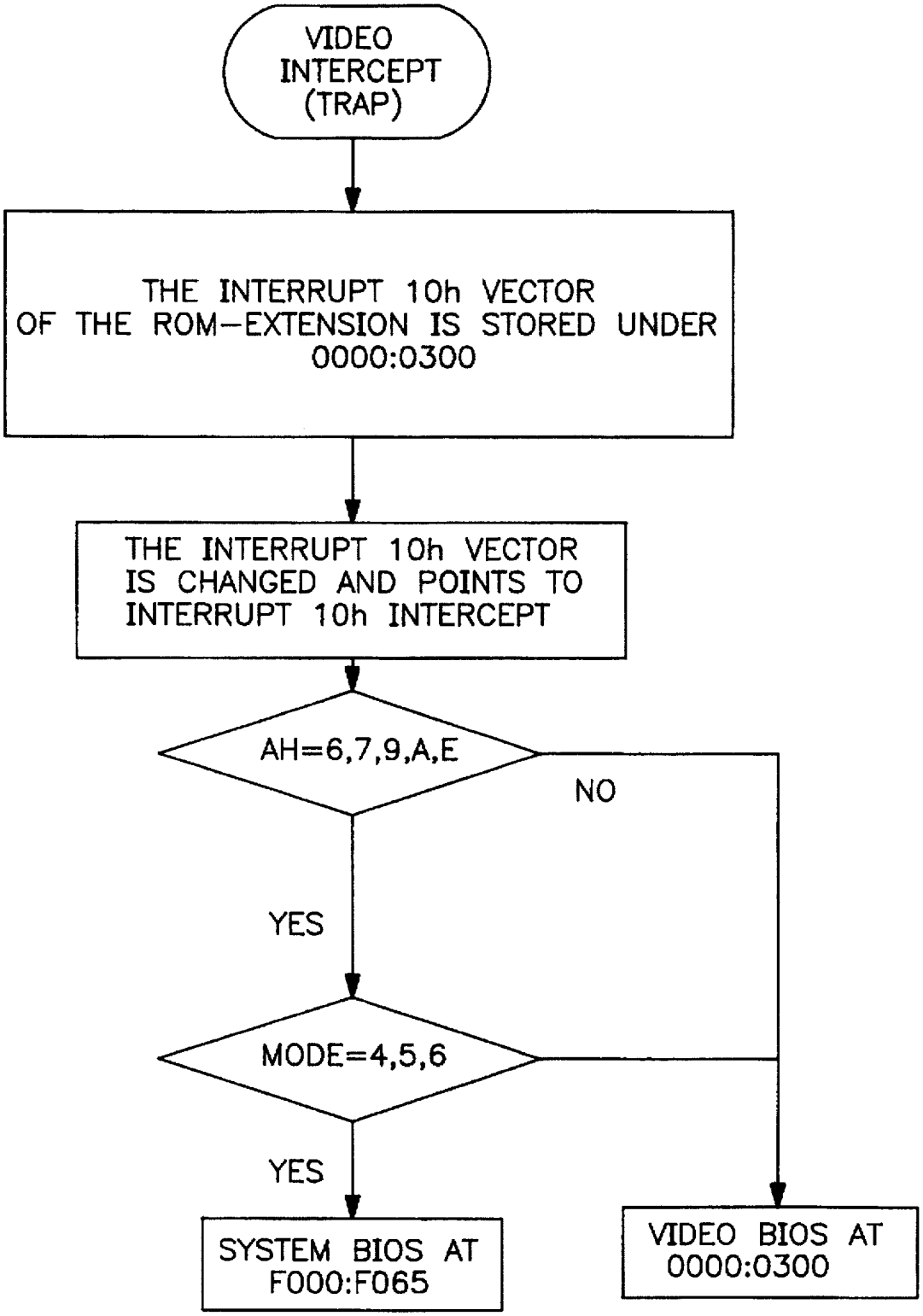

The ROM-module is used now for re-directing the interrupt-vector 10h on its own routine as this is illustrated further in FIG. 2. By this the normal function of the BIOS is replaced by a new function. The POST-test ends with a POST END. After that the interrupt 10h is called in the normal manner.

As can be seen from FIG. 2, the interrupt 10h of the ROM-extension is stored under the address 0000:0300. After that it is re-directed and now indicates to the interrupt-sector 10h intercept. By this a sub-routine is called, in which initially it is checked whether the function AH=6,7,9, A or E exists. If the answer is no, the main memory location 0000:0300 in the video-BIOS is called. If the answer is yes, a test is started whether the CGA-compatible modes 4,5 or 6 exist. With a no-answer to that the named video-BIOS-address is asked, again, with a yes-answer the re-direction according to the invention occurs in the system-BIOS to the address F000:F065.

The modified environment of the BIOS-codes has the following entry parameter:

BH attribute

DL colour (BH & 3)

CX number of repeats of the text characters

ES:DI locator for the correction of raster-lines and raster-columnand in the memory for even-numbered raster-lines DS:SI locator (pointer) to the character set of the text to be illustrated The code runs as follows:

1. repeat CX times a. repeat 4 times (4 times 2 raster-line pairs=8 raster-dots, store SI, DI
   - i. keep to the even-numbered byte (8 times 1 pixel per bit) in DH and set AX=0.
   - ii. repeat 8 times
     - (1) move DH left by 1
     - (2) if carry OR AL,DL
     - (3) move AX left by 2
   - iii. swap AL,AH
   - iv. if the attribute is bigger than 127, then XOR AX with ES:[DI]
   - v. store in memory
   - vi. move ES:DI, so that it points to an odd-numbered raster-line (scan-line).
   - vii. keep the odd-numbered byte and repeat steps ii. to v.
   - viii. move ES:DI so that it points to an even-numbered raster-line (scan-line).

b. increment to next text character position S(DI+=2)

2. end

Figure 3:
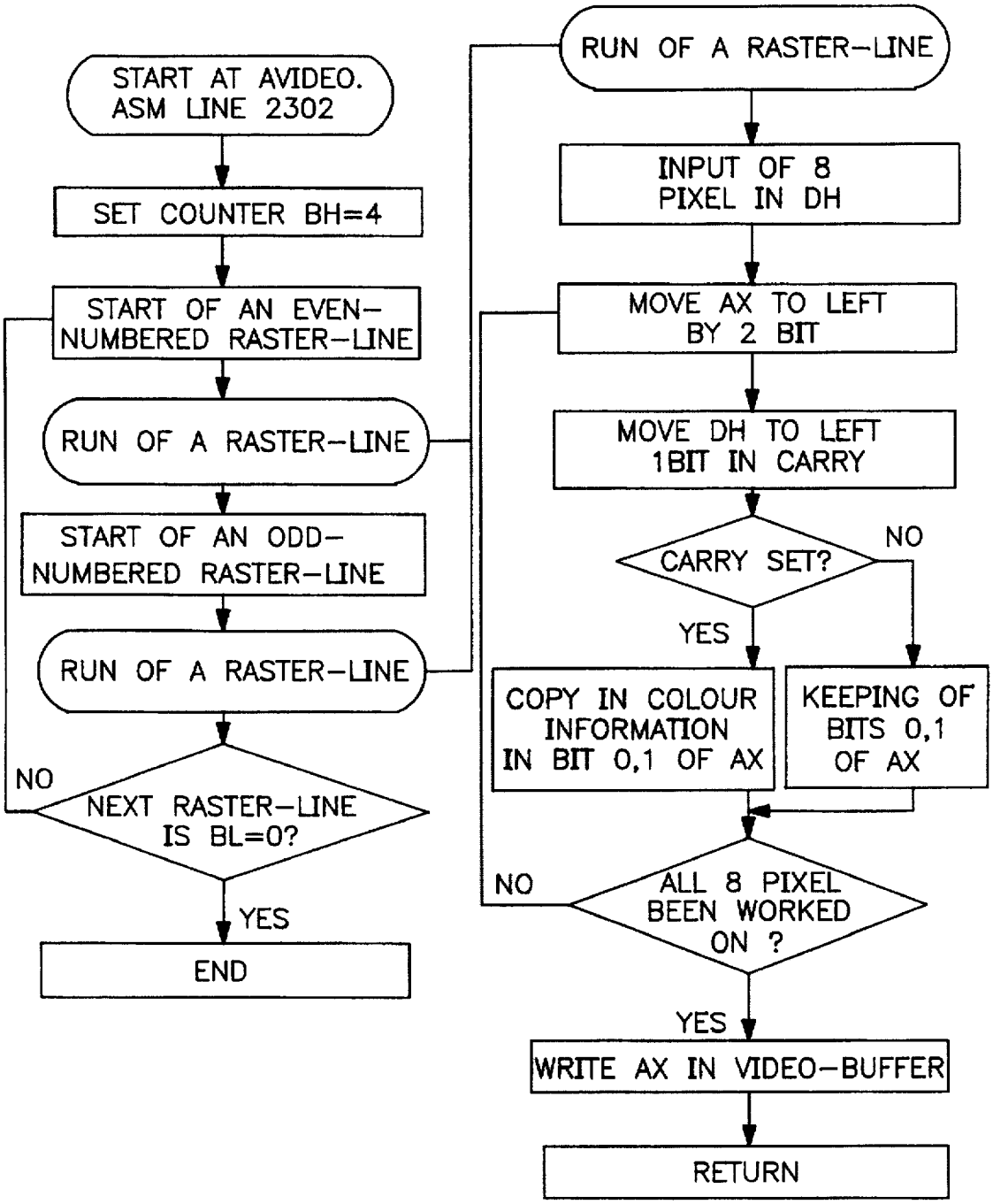

FIG. 3 shows the individual steps with the image structure from even-numbered scan-lines and odd-numbered scan-lines.

By a video-card with at least VGA-characteristics a video-card is meant which has a resolution of at least one VGA-card meaning e.g. Super VGA.

By the term screen we mean a so-called cathode-ray tube, with which at least one electron-beam is lead, screened line-shaped over an image area, covered with phosphorescent material,

We claim:

1. A system for presenting a text in the CGA-graphic mode on a screen of a personal computer comprising a processor;

means for memory associated with said processor;

binary patterns of said text stored in said processor memory means;

pixels for presenting said text on said screen;

each pixel on said screen representing one bit of memory stored in said processor memory means;

a video-card which is at least a VGA-card;

an external bus which is at least 16 bits wide for connecting said video-card to said processor;

means for memory associated with said video-card;

said video-card memory means being presentable on said screen;

wherein a demand for a text character results in said binary pattern corresponding to said text character being recalled from said processor memory means and a character-color and a background-color being stored as a pixel-pattern in said video-card memory means and being displayed on said screen;

said pixel-pattern of said text character being produced in the immediate environment of said processor memory means;

wherein said external bus transfers said pixel-pattern of said text character to said video-card;

wherein text-output is accomplished by a bit sequence having two-bits being produced for each pixel;

said background-color being determined;

said stored bit pattern of said text being connected to said bit sequence;

so that if the bit 0 exists in said stored bit patterns for said respective pixel, no change is made, and if the bit 1 exists in said stored bit patterns for said respective pixel, a bit sequence containing two bits is produced and stored in said video-card memory means for determining the desired front color.

2. An apparatus according to claim 1, wherein said bit sequences containing two bits are bits 00.

3. An apparatus according to claim 1, wherein said processor memory means comprises a cache-memory.

4. Procedure for the presentation of text in the CGA-graphic mode on a screen of a personal computer, which on one hand shows a processor and a memory allocated to it, in which binary patterns of the text to be presented by pixels on the screen are stored, where for each pixel on the screen one bit is stored, and on the other hand a video-card connected with said processor via an external bus, the video-card possessing a video-memory whose memory contents can be presented on the screen, whereby on demand of a text character first of all its binary pattern is recalled from the memory, this is supplemented by character-colour and background-colour stored as a pixel-pattern in the video-memory and displayed on the screen, characterized by the fact that said external bus is at least 16 bit wide and that the video-card is at least a VGA-card and the complete pixel-pattern of the text character to be presented is produced in the immediate environment of the processor in the memory and is transferred in this form via the external bus to the video-card, that for text-output a bit-sequence containing two-bits, especially 00, is produced for each pixel, determining the background-colour, and that the stored bit pattern of the text signs is connected with this bit-sequence, by always, if in the stored bit pattern for the respective pixel, the bit 0 exists, no change is made, and always, if in the stored bit for the respective pixel the bit one exists, a bit sequence, containing two bits, is produced which determines the desired front colour and which is stored in the video-memory.

* * * * *